United States Patent [19]

Miklos

[11] Patent Number: 4,949,625

[45] Date of Patent: Aug. 21, 1990

[54] AIR VOLUME DAMPER KIT AND ASSEMBLY

[76] Inventor: Louis F. Miklos, Howard Industries, Inc., Box 500, East Chicago, Ind. 46312

[21] Appl. No.: 355,166

[22] Filed: May 22, 1989

[51] Int. Cl.[5] ..... F24F 13/10

[52] U.S. Cl. ..... 98/41.1; 251/115; 251/228; 251/293; 251/298

[58] Field of Search ..... 98/41.1; 251/293, 228, 251/298, 115

[56] References Cited

U.S. PATENT DOCUMENTS

| | | | |
|---|---|---|---|
| 833,554 | 10/1906 | Schwoll | 251/228 X |
| 2,224,208 | 12/1940 | Acer | 251/298 X |
| 2,342,877 | 2/1944 | Maage, Jr. | 98/41.1 X |

FOREIGN PATENT DOCUMENTS

| | | | |
|---|---|---|---|
| 528751 | 8/1956 | Canada | 251/298 |
| 71281 | 11/1946 | Norway | 98/41.1 |
| 62285 | 10/1912 | Switzerland | 251/228 |
| 88672 | 3/1937 | Switzerland | 251/228 |

OTHER PUBLICATIONS

Advertisement for Ventlok brand Ball Joint Bracket No. 603 and Ventlok brand Damper Blade Bracket No. 600.

*Primary Examiner*—Harold Joyce
*Attorney, Agent, or Firm*—Richard G. Kinney

[57] ABSTRACT

A kit and assembly for making an air volume damper for use in the ductwork of a heating and ventilating system. The kit includes a long rod with a single bend at one end to form an L-shaped member, a hinge bracket for being riveted to a damper plate and receiving and captivating the bent section of the rod, a plate for being riveted to the outside of a duct and receiving the rod end through it, and a spring lock or latch member for being pop riveted to the plate and including a spring metal V-shaped section which receives the rod through two holes, one on each leg of the V-shaped section, and secures the rod by spring pressure. Compressing the legs of the V-shaped section together loosens the grip on the rod and allows it to be moved longitudinally to adjust a damper blade. The kit further includes press-together plastic hinge members for forming the hinge of the damper blade and pop rivets for securing the hinge bracket to the blade, the plate member to the outside of the ductwork and the lock member to the plate.

10 Claims, 2 Drawing Sheets

AIR VOLUME DAMPER KIT AND ASSEMBLY

FIELD OF THE INVENTION

The present invention relates to a kit, a control assembly and an adjustable damper for air volume control in heating or ventilating ducts.

BACKGROUND OF THE INVENTION

Air volume dampers are used in the heating and ventilating industry to balance the amount of air to be either supplied or exhausted from a specific area. Conventional commercial dampers require a wrench or screwdriver to loosen and then again tighten or adjust a push-pull rod to lock it and the damper blade in position. This process is often repeated many times in initially installing a heating/ventilating system to insure proper "balance" or air flow to various rooms or portions of the space to be heated/cooled or ventilated. Also, conventional dampers require the use of a screwdriver and wrench on bolts and nuts to assemble it into position and employ metal casting lock or latch member with set screw or bolts lock arrangement.

There thus exists a need for a kit of component parts for assembling and installing an easily adjusted damper.

SUMMARY OF THE INVENTION

In providing a solution to one or more of the problems in the prior art, the present invention provides those in the field with a kit which can be used with conventional tools to make a damper which is easily adjusted without the need of any tool.

The kit comprises a control rod, a hinge bracket for being riveted to a damper blade and for receiving one end of the rod, a plate member for being mounted to the outside of the duct and for receiving the rod through its end. The plate member also serves to receive a lock member. And the kit includes such a lock member which features a flat spring member with separated holes for receiving the rod. The natural spring of the spring member cooperates with the holes to lock itself onto the rod. However, when the spring member is manually compressed it releases the rod and allows it to be moved longitudinally through the holes. The kit further includes blade hinge members for forming the blade's hinges and sufficient fasteners for securing the hinge bracket to the blade, the plate to the duct and the spring lock member to the plate.

The invention, together with the advantages thereof, may best be understood by reference to the following description taken in connection with the accompanying drawings, in the several figures of which, like reference numerals identify like elements.

DETAILED DESCRIPTION OF PREFERRED EMBODIMENT

Figure 1:
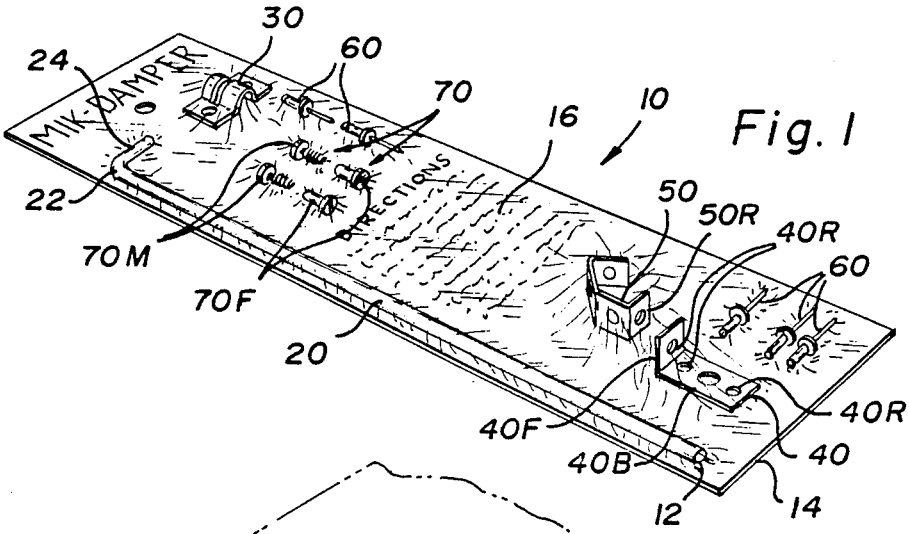
FIG. 1 is a perspective view of a kit of parts made in accordance with the present invention.

Referring to FIG. 1 there is depicted a kit made in accordance with the present invention and generally designated by the number 10. The kit 10 is shown mounted by shrink-wrap transparent plastic cover 12 to a cardboard backing 14 which preferably is imprinted with the directions 16 such as those set out below.

The kit 10 includes a control rod 20 having a 90-degree bend 22 toward one end and a short pivot section 24 formed by that bend. The rod 20 is formed of a circular cross sectional rod and is sized to the ductwork and damper to be made and controlled. For most residential ductwork a rod of about twelve inches in length and three-sixteenths of one inch diameter has been found to be adequate. For larger dampers, the rod and other parts of the kit 10 can be upsized.

The kit 10 further includes a hinge member 30, a latch plate 40, a locking control member 50, five pop rivets 60 and a pair of two-part rapid assembly pivot members 70. These latter each comprise a female top or post portion 70F made of polyethylene and a male or screw portion 70M made of nylon. The two parts mate together by finger-pressing the threaded rod section 70M into a threaded opening in post 70F to create the assembly shown at 70 in FIGS. 2 and 3. This pressing together of the two parts 70M and 70F locks them together. However, they may be unscrewed using a conventional screwdriver, if desired. This member 70 may be the conventionally available product made by Park-Plas Products Inc. of Flippin, Ark. 72634 (part number 2050375SW).

Figure 7:
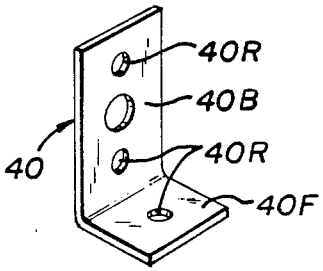
FIG. 7 is a detailed perspective view of one part of the assembly and kit of FIGS. 1–6.
Figure 8:
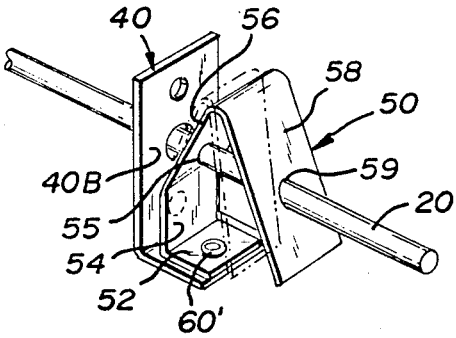
FIG. 8 is a view similar to that of FIG. 7 showing the interconnection and operation of certain parts of the kit and assembly of FIGS. 1–7 with one part's moved position shown in phantom outline.

The pop rivets 60 are arranged on the cardboard backing 14 adjacent to the parts with which they are to be used when assembled with the other parts into a finished assembly 100 as shown in FIGS. 2–5. The plate 40 (as best shown in FIG. 7) is provided with a flat back portion 40B which includes two rivet receiving holes 40R. The plate 40 also includes a flange 40F which projects at 90 degrees from its back 40B and also has a rivet receiving hole 40R. Similarly, the hinge member 50 has a base 52 with a rivet receiving hole 50R to allow it to be riveted to the flange 40F. of plate 40 (as shown in FIG. 8).

Figure 5:
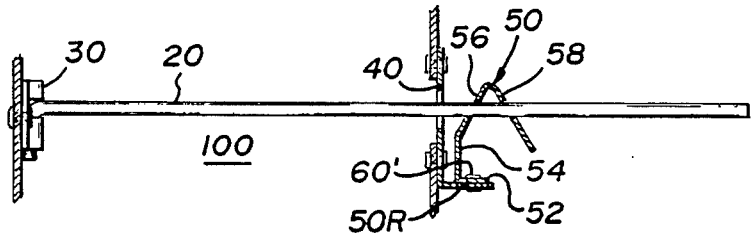
FIG. 5 is a side view of the assembled parts of FIG. 4 with parts shown in section.

The member 50 is preferably made of a rectangular strip of spring metal which is bent (as best shown in FIG. 5), so that one end forms a base 52. Adjacent the base 52 is a vertical section 54 followed by a first leg section 56 bent backward at about 30 degrees and finally a reverse bent free end section or second leg 58. As shown in FIG. 5, the leg sections 56 and 58 form an upside-down V assembly. The spring strength of the V sections is such that they respond to ordinary hand-compression.

Besides rivet receiving holes the back 40B of the member 40 includes a large central hole which serves to loosely receive the rod 20 in the assembly as shown in FIGS. 2–5 and 8. The latch member 50 also has a pair of rod receiving holes 55 and 59 in, respectively, the sections 56 and 58. These holes 55 and 59 are sized in relation to the diameter of the rod 20 such that the rod may loosely fit into either hole, when the section 56 or 58 is aligned at approximately 90 degrees to the rod 20 plus or minus about 15 degrees. For example, with a three-sixteenths inch diameter rod, a seven-thirty-second inch diameter hole through a one-thirty-second inch thick plate will bend at about 75 degrees. Thus, when the plane of the sections 56 or 58 moves to approximately 75 degrees the edges of the holes 55 or 59 contacts and binds the rod 20.

Now, the V spring formed by sections 56 and 58 are such that in a natural or relaxed state they are at an angle of about 60 degrees. The holes 55 and 59 are aligned horizontally, as shown in FIG. 5. For the rod to pass through the two holes 55 and 59 the spring metal free end section 58 must be pushed inward to compress the V spring to an angle of less than 30 degrees (as shown in dashed lines in FIG. 8) and when released the spring pressure captivates the rod and holds it against longitudinal movement. By compressing the V spring members 56 and 58 together the rod is free to be moved longitudinally through the holes in either direction.

Figure 6:
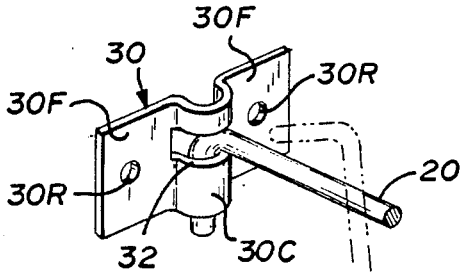
FIG. 6 is a detailed perspective view of certain parts of the kit of FIG. 1 and the assembly of FIGS. 2–5 showing the method of assembling one part into the others with one part shown in a moved position in phantom outline.

The hinge member 30 as best shown in FIG. 6 is made with a curved central section 30C having a curving slot 32 sized to loosely receive the rod 20 as there shown. The rear of the generally cylindrical volume defined by the section 30C is open. The clearance of the slot 32 is such that the rod end portion 24 can be easily inserted (before the member 30 is secured against a wall and the rear of the volume of space defined by section 30C is closed by the wall).

Assembling the Kit's Components and Making a Damper or Diverter

The kit 10 of FIG. 1 can be easily transferred into the assembly 100 of FIGS. 2–5 using a few readily available hand tools. Needed are a drill (for example, the conventional electric drill with a few different sized conventional drill bits), and a conventional hand-operated pop rivet gun. Both of these tools are commonly used by those installing ductwork and thus should be already on hand for the typical uses of the kit 10. (Other tools of possible use are a conventional screwdriver, shears and a small brake for bending sheet metal, also commonly used by ductwork installers.) The user of the kit must provide a damper blade 75 of FIGS. 2 and 3.

Figure 2:
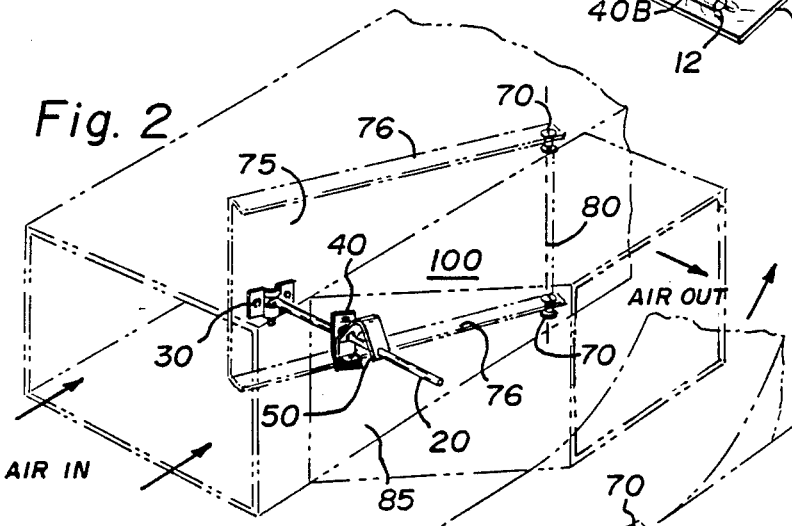
FIG. 2 is a perspective view of a damper and diverter control assembly constructed with the kit of FIG. 1 shown in a duct system, wherein the assembly is shown in solid lines and the damper and the ductwork are shown in phantom outline.
Figure 3:
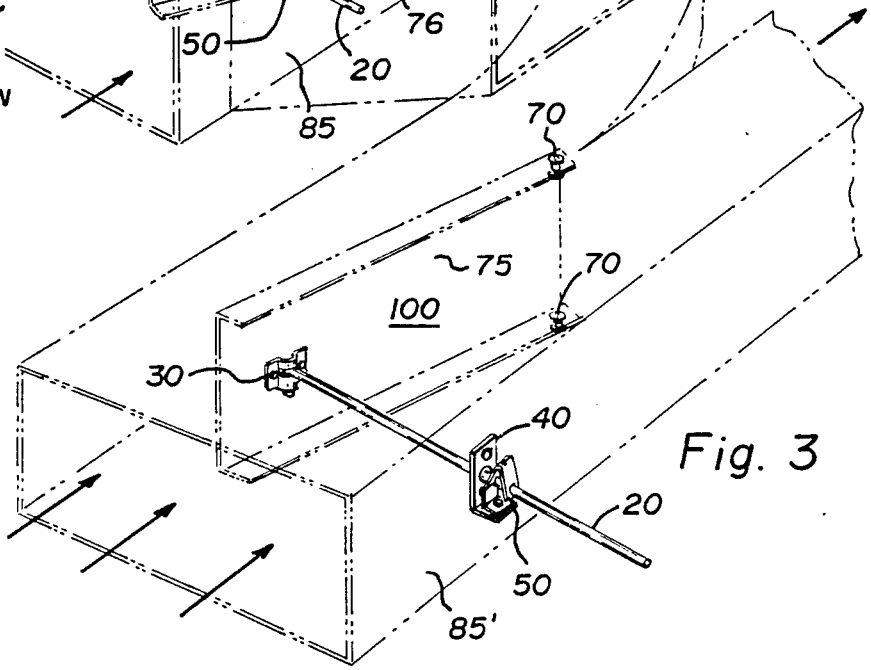
FIG. 3 is a view similar to that of FIG. 2 wherein the kit of FIG. 1 has been used to provide a diverter.

The blade 75 is first formed, e.g., by forming scrap sheet metal to the shape and size shown in FIGS. 2 and 3. The blade 75 is preferably provided with top and bottom flanges 76 and holes drilled therein for receiving the pivot members 70. These holes are formed at the desired pivot axis 80, and using the member 30 as a template, a pair of rivet receiving holes are drilled in the blade. Holes for the members 70 are drilled into the duct 85 at the axis 80 (FIG. 2) using the blade 70 as a template.

The plate 40 (FIG. 7) is used as a template to locate the position for drilling three holes in the duct 86 (FIG. 3) or duct 85 (FIG. 2). The plate 40 is then pop riveted in place on the outside of the ductwork. And with the rod 20 passing through the large hole in the duct 85 or 86 and through the large hole of the plate 40, the rod section 24 is inserted into the hinge bracket 30 as shown in FIG. 6, which bracket 30 is then pop riveted to the blade 75. The blade 75 is then aligned and the pivot members 70 assembled by pressing the two parts together to form the hinge at the axis 80.

Finally, the latch member 50 which forms a leaf spring is compressed and slid onto the rod 20 and positioned as shown in FIG. 8 and pop riveted into the flange 40F of the plate 40.

The assembly 100 is now complete and the position of the damper blade 75 (or 75' of FIG. 3) can be easily adjusted from the outside of the duct by pressing on section 58 of member 50 and pushing the rod in or pulling it out. Releasing the pressure on section 58 causes it and the section 56 to both lock to the rod 20 and thus holds the rod 20 and the blade 75 in the desired location.

Figure 4:
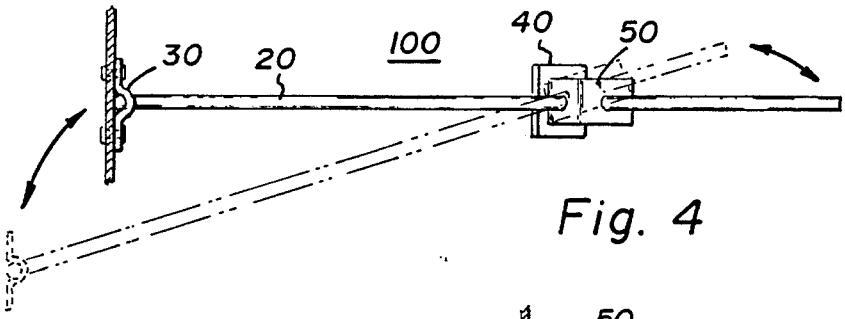
FIG. 4 is a top view of the assembly made from the kit attached to a damper/diverter blade with part of the blade shown in section and with a moved position of parts shown in phantom outline.

As shown in FIG. 4, the single pop rivet securing the members 50 and 40 together serves as a pivot to allow the member 50 to pivot about a vertical axis so as to accommodate the geometry of the different positions for the rod 20.

It should now be apparent that a useful and advantageous kit and assembly have been described. The finished damper system can be easily adjusted. No tools are required for balancing the air flow. The position of the diverter or damper blade 75 can be easily adjusted by compressing the legs of lock 50 with thumb and forefinger to manually flex it and to allow the holes to align. When this is done the rod 20 may be pushed or pulled with the other hand to move the blade 75 to the desired position. When in that position the lock 50 is released and the rod 20 and thus the blade 75 are locked in place.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A kit for forming an air volume damper in an air duct having sidewalls using a damper blade sized to fit and move inside the air duct or takeoff branch, comprising:

a damper control rod having a control end and an attachment end;

a blade bracket for receiving and holding the attachment end of said control rod such that the rod may pivot therefrom;

means for attaching said blade bracket to the blade;

damper blade hinge means for hingedly attaching the blade inside the duct or takeoff branch;

manually releasable rod captivating means;

bracket means for mounting said manually releasable rod captivating means;

means for securing said captivating means and said mounting means to the wall of the duct or takeoff branch; wherein said releasable rod captivating means includes a spring detent for captivating the rod, which spring detent is manually releasable; and wherein said spring detent comprises leaf spring means having two flat leaf sections which are manually movable relative to one another and each of which define an aperture for receiving the rod therethrough, which rod may easily slide through said apertures when the leaf spring means is manually flexed but is captivated thereby when not manually flexed.

2. The kit of claim 1 wherein said leaf spring means is formed into a V shape with said flat apertured sections on opposite legs of the V with said sections when relaxed or uncompressed being at a first angle, said sections being at a smaller second angle when the rod is passed through the apertures so as to bear against the rod with spring pressure and being manually compressible so as to be at a still smaller third angle wherein the rod may slide freely through the apertures.

3. The kit of claim 2 wherein said control rod is of a generally L shaped, with a short rod section and a long rod section at approximately right angles;

said blade bracket receiving said short section wherein it serves as a pivot pin.

4. The kit of claim 3 wherein said means for attaching said blade bracket and said means for securing said releasable rod captivating means to the wall are pop rivets.

5. The kit of claim 4 wherein said blade hinge means is a pair of two-part rapid assembly fasteners.

6. A kit for forming an air volume damper in an air duct having sidewalls using a damper blade sized to fit and move inside the air duct or takeoff branch, comprising:

a damper control rod having a control end and an attachment end;

a blade bracket for receiving a holding the attachment end of said control rod such that the rod may pivot therefrom;

means for attaching said blade bracket to the blade;

damper blade hinge means for hingably attaching the blade inside the duct or takeoff branch;

manually releasable rod captivating means;

bracket means for mounting said manually releasable rod captivating means;

means for securing said captivating means and said mounting means to the wall of the duct or takeoff branch;

wherein said control rod is of a generally L shape, with a short rod section and a long rod section at approximately right angles; and said blade bracket receiving said short section wherein it serves as a pivot pin; and wherein said blade bracket defines a volume open for receiving the short section of said rod, a horizontal slit from which the long section of said rod projects, said bracket being open to the rear of said volume so as to allow the rod to be fed through the slot prior to securing the bracket to the blade but which opening is thereafter closed by the blade surface to captivate the short section of each rod therein when the bracket is affixed to the blade surface.

7. A manual control assembly for a pivotable diverter or damper blade in ductwork, comprising, in combination:

a damper control rod having a control end and an attachment end;

a blade bracket receiving and holding the attachment end of said control rod such that the rod may pivot and extend therefrom;

means for attaching said blade bracket to the blade;

a pair of damper blade hinge means for hingedly attaching the blade inside the ductwork;

manually releasable rod captivating means mounted to the ductwork and manually operable from the outside of the ductwork, said rod captivating means receiving and releasably captivating said control rod with the control end outside of the ductwork, said captivating means including a manually compressible spring which, when compressed, releases the rod and when released captivates it;

wherein said control rod is of a generally L shape, with a short rod section and a long rod section at approximately right angles; said blade bracket receiving said short section wherein it serves as a pivot pin; and wherein said blade bracket defines a volume open for receiving the short section of said rod, a horizontal slit from which the long section of said rod projects, said bracket being open to the rear of said volume so as to allow the rod to be fed through the slot prior to securing the bracket to the blade but which opening is thereafter closed by the blade surface to captivate the short section of each rod therein when the bracket is affixed to the blade surface.

8. The assembly of claim 7 wherein said spring detent comprises a leaf spring having two flat sections which are manually movable relative to one another and each of which define an aperture for receiving the rod therethrough, which rod may easily slide through said apertures when the leaf spring is manually flexed but is captivated thereby when not manually flexed.

9. The assembly of claim 8 wherein said leaf spring is formed into a V shape with said flat apertured sections on opposite legs of the V and said sections during a relaxed or uncompressed first angle, said sections being at a smaller angle when the rod is passed through the apertures so as to bear against the rod with spring pressure and being manually compressible so as to be at a still smaller angle wherein the rod may slide freely through the apertures.

10. In an air volume damper assembly, of the type which has a damper blade mounted within ductwork, which blade is movable by a rod attached to the blade, which rod extends to the exterior of the ductwork, the improvement in means for releasably captivating the rod comprising:

a flat or leaf spring means which is manually compressible by ordinary hand and finger pressure and which has a pair of spaced-apart apertures, each of which is sized to loosely receive the rod when aligned with the aperture but which when at an angle to a received rod presses against the rod so received, said spring means when not manually compressed and when receiving the rod through said apertures captivates the rod by pressing against the portions of the rod received in said apertures, but when manually compressed when receiving the rod through said apertures loosens its grip on the rod and allows it to move longitudinally through said apertures; and means for mounting said spring means to ductwork at the place where the rod extends out of the ductwork; whereby the damper blade may be easily adjusted and readjusted by hand and without the need of any tool, by manually compressing said spring means and sliding the rod and thus the blade to a desired position and then releasing the spring means and allowing it to captivate the rod in that position.

* * * * *

UNITED STATES PATENT AND TRADEMARK OFFICE

CERTIFICATE OF CORRECTION

PATENT NO. : 4,949,625

DATED : August 21, 1990

INVENTOR(S) : Louis F. Miklos

It is certified that error appears in the above-identified patent and that said Letters Patent is hereby corrected as shown below:

Column 5, Claim 6, line 33, after "receiving", change "a" to --and--.

Signed and Sealed this

Twenty-fifth Day of February, 1992

*Attest:*

HARRY F. MANBECK, JR.

*Attesting Officer*

*Commissioner of Patents and Trademarks*